United States Patent [19]

Thorpe

[11] Patent Number: 4,682,071

[45] Date of Patent: Jul. 21, 1987

[54] LAMPS AND RIBBON SEALS

[75] Inventor: Paul Thorpe, Greater Manchester, England

[73] Assignee: The General Electric Company, p.l.c., England

[21] Appl. No.: 876,276

[22] Filed: Jun. 19, 1986

Related U.S. Application Data

[63] Continuation-in-part of Ser. No. 496,130, May 19, 1983, abandoned.

[30] Foreign Application Priority Data

May 28, 1982 [GB] United Kingdom ..... 8215699

[51] Int. Cl.[4] ..... H01J 5/32

[52] U.S. Cl. ..... 313/43; 313/623; 313/635; 313/332

[58] Field of Search ..... 313/43, 331, 635, 623, 313/332

[56] References Cited

U.S. PATENT DOCUMENTS 2,353,668 7/1944 Hinman ..... 313/43 X
3,219,870 11/1965 Gottschalk ..... 313/625
3,351,798 11/1967 Bauer ..... 313/632 X

FOREIGN PATENT DOCUMENTS 2451626 11/1980 France ..... 313/331
599489 3/1948 United Kingdom .
660260 11/1951 United Kingdom ..... 313/43

*Primary Examiner*—Palmer C. DeMeo
*Attorney, Agent, or Firm*—Kirschstein, Kirschstein, Ottinger & Israel

[57] ABSTRACT

An electric lamp designed to operate in air and of the type incorporating at least one current-supply foil embedded within and extending along a light transmitting stem and welded at its inner and outer ends to an inner conductor and a terminal conductor respectively, in which the end face of the stem is unenclosed and is such that a proportion of radiation which is incident upon it from the lamp in use thereof is directed away from the foil and adjacent region of the terminal conductor. The invention is especially applicable to high power lamps and has the effect of reducing the temperature of the outer ends of the current-supply foils, which are vulnerable to oxidation.

7 Claims, 5 Drawing Figures

LAMPS AND RIBBON SEALS

CROSS-REFERENCE TO RELATED APPLICATION

This application is a continuation-in-part of patent application Ser. No. 496,130 filed May 19, 1983, and now abandoned

BACKGROUND OF THE INVENTION

The present invention relates to electric discharge and incandescent lamps of the type in which a light-transmitting envelope immediately surrounding the electrodes or filament, as the case may be, is arranged to operate in air, i.e. it is not sealed within an outer jacket which is evacuated or contains a non-oxidising atmosphere; such lamps will hereinafter be referred to as air-exposed lamps. In particular the invention relates to air-exposed lamps of the kind employing so-called "ribbon seals", such lamps incorporating at least one current supply foil, usually of molybdenum, embedded within and extending along a stem at an end of the envelope, the foil being connected electrically at its inner end to an inner conductor (which in the case of a discharge lamp carries or forms an electrode of the lamp and in the case of an incandescent lamp is connected to the lamp filament) and at its outer end to a conductor constituting a current supply terminal, the ends of the conductors that are connected to the foil being also embedded in the stem. One such lamp is described in U.K. Patent Specification No. 599489.

FIELD OF THE INVENTION

The invention is especially applicable to high power electric (e.g.2.5 kw) discharge lamps, such as the MEI lamp, which are used for television and film lighting. Such lamps comprise a silica envelope integral with either one or two silica stems in which current supply foils are embedded, and are referred to as single- and double-ended lamps respectively. In such lamps the terminal conductors are sometimes provided by flying leads, or more commonly provided by short metal pins connected electrically to metal lamp caps enclosing the outer ends of the respective lamp stems.

Since the terminal conductors do not form a completely air-tight seal with the surrounding silica, the welded ends of the foils are liable to oxidise and eventually break if they become hotter than about 250° C. In fact, tests have shown that in a 2.5 kw MEI discharge lamp provided with cylindrical silica supporting stems 110 mm long and 15 mm in diameter burning in a luminaire in still air, the temperature of the current-supply pins can easily reach 200° C. if no lamp caps are used and nearly 370° C. if conventional lamp caps are provided. Even when the capped lamp is run in a lampholder fitted with cooling fins the temperature of the pins can reach 320° C. Thus even when relatively long supporting stems are provided, the outer ends of the foils can become sufficiently hot for oxidation to occur.

DESCRIPTION OF THE PRIOR ART

Attempts have been made to reduce the amount of heat reaching the outer ends of the foils by locating a flat metal collar around the outer end of the or each supporting stem of the lamp between the or each welded end of the foil and the lamp envelope, as described in U.S. patent application Ser. No. 456,273 filed Jan. 6, 1983, by Angus Bernard Dixon , now abandoned in favor of U.S. patent application Ser. No. 804,096, filed Dec. 3, 1985.

The metal collar acts as an external heat shield, shielding the ribbon seal from heat and light radiated from the lamp envelope. A heat sink is commonly fitted to the lamp cap or current-supply pin to increase the heat dissipation from the seal.

An alternative method of cooling such lamps is by means of a blast of air as described in U.S. Pat. No. 2,353,668 issued to D. D. Hinman on July 18, 1944.

Even when such precautions are taken, it has been found necessary in some cases to make the stems much longer than is necessary to obtain effective ribbon seals, partly because of the heat and light radiated from the lamp envelope through the stems and also partly because of the heat conducted along the foils themselves. We believe that a considerable proportion of the heat and light that is transmitted directly or by internal reflections along the inside of the stem is directed on to the outer ends of the foils and adjacent parts of the terminal conductors by reflection or refraction after impingement on the end faces of the stems.

SUMMARY OF THE INVENTION

According to the present invention in an air-exposed lamp of the kind having an envelope in which there is contained means for generating light, the envelope being provided with at least one elongate stem which is at least partially transparent to radiations emanating from the interior of the emvelope in use of the lamp, the stem having an end face at a position remote from the envelope, at least one current-supply foil embedded within and extending along said stem and connected at its inner and outer ends to an inner conductor and a terminal conductor respectively, the foil being formed of a metal which is oxidisable when exposed to air at the elevated temperatures produced in use of the lamp, the end face of the stem is open to the atmosphere and is shaped and positioned to direct radiation incident upon it from the lamp away from the associated foil and terminal conductor so as to reduce the temperature of at least the outer end of the foil when the lamp is in use, and thus reduce the tendency to oxidation, thereby lengthening the lamp life.

The end face of the lamp stem may be highly polished so that a large proportion of the indicent radiation from the lamp is transmitted through it, as to escape from the lamp stem without being reflected back towards the foil. Where the end face of the lamp stem transmits a proportion of the radiation incident on it from the lamp in use it may be of flared shape with the angle which it makes with the axis of the stem increasing progressively away from said axis, which has been found to cause an appreciable proportion of the incident radiation from the lamp to be refracted away from the associated foil and terminal conductor.

Alternatively said end face may be provided with a reflective surface of a shape such as to direct radiation incident upon it from the lamp away from any associated foil and terminal conductor.

A lamp in accordance with the invention may be provided with a lamp cap, but in such a case the cap is of an open tubular shape fitted around the lamp stem without enclosing the end face of the stem. The lamp cap may or may not be electrically connected to said terminal conductor.

In a double-ended lamp a lamp cap preferably surrounds each of the lamp stems, such a lamp being readily fitted into and removed from co-operating current supply sockets.

Where the stem of a lamp in accordance with the invention has one or more rigid terminal conductors projecting from it a member such as a metal block having a reflective surface facing the lamp stem may be attached to the terminal conductor or conductors, the surface being non-perpendicular to the stem axis so as to direct radiation impinging upon it from the lamp away from the end of the stem.

DETAILED DESCRIPTION OF THE DRAWINGS

Figure 1:
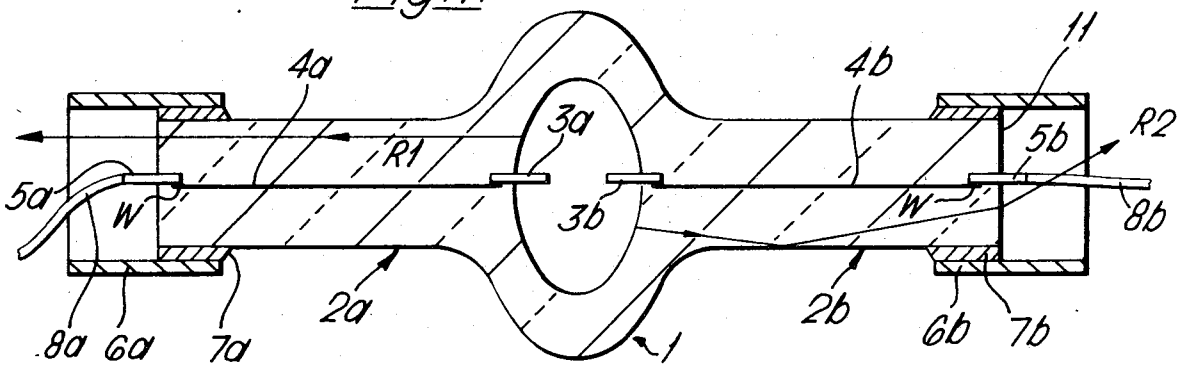
Figure 2:
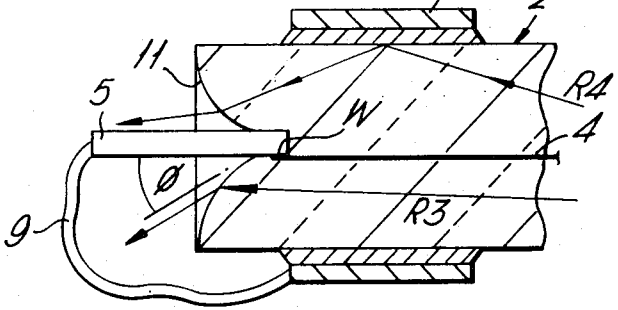
Figure 3:
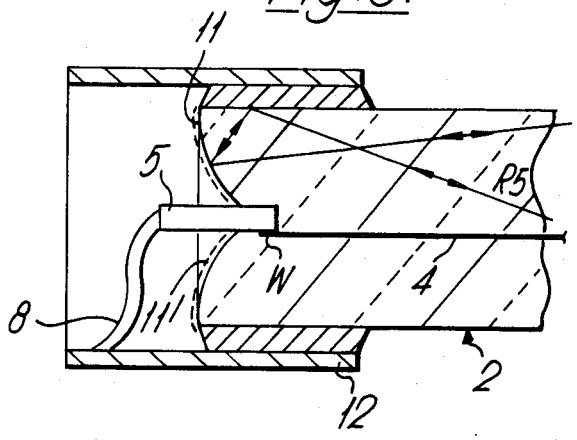
Figure 4:
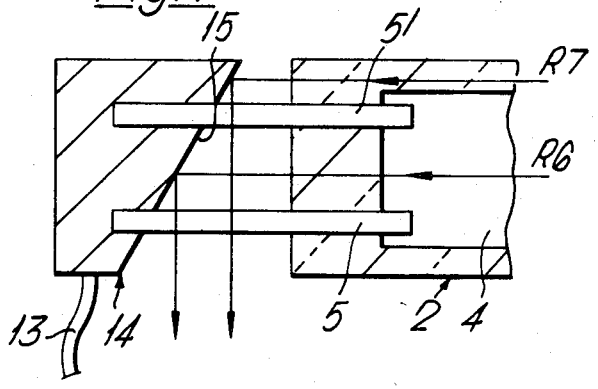
Figure 5:
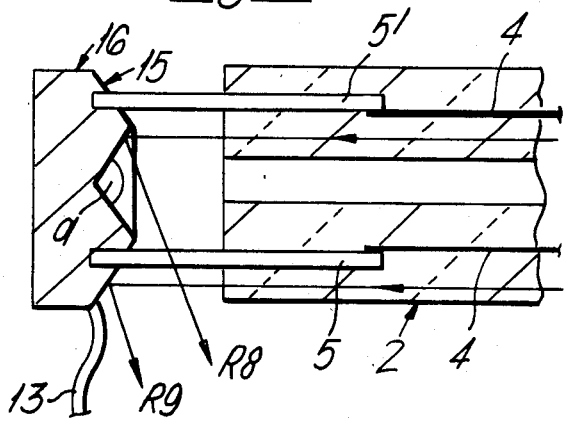

The invention will now be described by reference to FIGS. 1 to 5 of the accompanying drawings, of which :

FIG. 1 is a diagrammatic axial cross section, partially cut away, of a double-ended discharge lamp in accordance with the invention, FIG. 2 is a diagrammatic axial cross section, partially cut away, of one lamp stem of another double-ended lamp in accordance with the invention, FIG. 3 is a diagrammatic axial cross section, partially cut away, of yet another lamp stem for a double-ended lamp in accordance with the invention, FIG. 4 is a diagrammatic axial cross section, partially cut away, of a lamp stem for a high power double-ended lamp in accordance with another embodiment of the invention, and FIG. 5 is a diagrammatic axial cross section, partially cut away, of another stem for a high power lamp in accordance with yet another embodiment of the invention.

DESCRIPTION OF THE PREFERRED EMBODIMENTS

Referring to FIG. 1, the lamp shown comprises a silica envelope 1 integral with two silica stems 2*a* and 2*b*. Tungsten electrodes 3*a* and 3*b* are connected to molybdenum current-supply foils 4*a* and 4*b* respectively, which form ribbon seals with the stems and are welded to short terminal pins 5*a* and 5*b* at W. Open tubular lamp caps 6*a* and 6*b* are connected at 7*a* and 7*b* to the stems and in use, serve to support the lamp, without enclosing the end surfaces 11 of the stems 2*a*, 2*b*. Braided leads 8*a* and 8*b* are electrically connected to the pins 5*a* and 5*b* respectively for connecting the pins to a power supply. Visible, U.V. and I.R. rays such as R1 and R2 propagating along the stems can escape freely from the polished end surfaces 11 of the lamp stem through the open ends of the caps as shown. Reflection onto the terminal pins 5*a* and 5*b* is thereby drastically reduced. Furthermore the caps 6*a* and 6*b* absorb very little of the radiation escaping from the ends of the stems and consequently do not reradiate heat onto the current-supply pins to a significant extent. The temperatures of the vulnerable welded regions W of the current-supply foils 4*a* and 4*b* are thus considerably lower than in prior art designs using closed caps.

The stem 2 shown in FIG. 2 is provided with a cap in the form of a cemented tubular metal collar 10 which in this case is electrically connected to a terminal 5 by a lead 9. In use, therefore, the collar 10 acts both to support the lamp and as an electrical connector. The end surface 11 of the stem is smoothly polished and flared, so that rays such as R3 and R4 which would otherwise impinge on the pin 5 are refracted away from it, thereby ensuring that the welded region of the foil stays cool. Preferably the limiting angle of flare $\phi$ with respect to the stem axis is slightly greater than the critical angle of the stem-air interface, in order to prevent multiple internal reflections at the end of the stem.

The stem 2 shown in FIG. 3 is cemented to a open lamp cap 12 , which is connected to a current-supply pin 5 by a lead 8 as in FIG. 2. The end surface 11 of the stem is flared, and is provided with a reflective coating 11' (shown dashed). Since the reflective surface 11 is flared, it reflects very few rays onto the welded region W of the current-supply foil 4. A typical ray path is illustrated by R5.

FIG. 4 shows the end of one stem of a high power (eg. 2.5 kw) double-ended lamp. A single current-supply foil 4 carries current to one of the electrodes or one terminal of the filament (not shown) and is connected via stout pins 5 and 5' to a common metal block 14 which is connected to a power-supply terminal (not shown) by a flying lead 13. The pins 5 and 5' and block 14 form a rigid self-supporting assembly. A polished surface 15 of the block 14 is angled to reflect rays such as R6 and R7 approximately perpendicular to the stem axis.

FIG. 5 shows yet another embodiment. In this embodiment a plurality of foils 4 are embedded in the wall of a tubular stem 2 and are connected via respective current-supply pins 5, 5' to a generally cylindrical metal block 16. This block has a reflective surface 15 formed with a shallow central conical depression defining an angle a. The angle a is preferably greater than 90° and less than 140°. The current-supply pins 5 and 5' protrude from the tubular stem 2 and support the block 16 at such a distance from the end of the stem that rays such as R8 which strike the depression are reflected once and escape between the block and the stem. The edges of the surface 15 are preferably orientated so as to reflect rays such at R9 outwardly. This arrangement ensures that very little of the heat and light escaping from the end of the stem is reflected back onto the current-supply pins, and the block is efficiently cooled by convection.

We claim :

1. An air-exposed lamp of the kind having an envelope in which there is contained means for generating light, the envelope being provided with at least one elongate stem which is at least partially transparent to radiations emanating from the interior of the envelope in use of the lamp, said at least one stem having an end face at a position remote from the envelope, at least one current-supply foil embedded within and extending along said at least one stem and connected at its inner and outer ends to an inner conductor and a terminal conductor respectively, the foil being formed of a metal which is oxidizable when exposed to air at the elevated temperatures produced in use of the lamp, wherein the end face of said at least one stem is open to the atmosphere and is highly polished so that a large proportion of radiation from the lamp which is incident upon it is transmitted through it without being reflected back towards the foil so as to reduce the temperature of at least the outer end of the foil when the lamp is in use, and thus reduce the tendency to oxidation, thereby lengthening the lamp life.

2. An air-exposed lamp of the kind having an envelope in which there is contained means for generating light, the envelope being provided with at least one elongate stem which is at least partially transparent to radiations emanating from the interior of the envelope in use of the lamp, said at least one stem having an end face at a position remote from the envelope, at least one current-supply foil embedded within and extending along said at least one stem and connected at its inner and outer ends to and inner conductor and a terminal conductor respectively, the foil being formed of a metal which is oxidizable when exposed to air at the elevated temperatures produced in use of the lamp, wherein the end face of said at least one stem is open to the atmosphere, and is provided with a reflective surface of a shape such as to reflect radiation incident upon it from the lamp away from the associated foil and terminal conductor so as to reduce the temperature of at least the outer end of the foil when the lamp is in use, and thus reduce the tendency to oxidation, thereby lenghtening the lamp life.

3. An air-exposed lamp of the kind having an envelope in which there is contained means for generating light, the envelope being provided with at least one elongate stem extending along a lamp axis and being at least partially transparent to radiations emanating from the interior of the envelope in use of the lamp, said at least one stem having an end face at a position remote from the envelope, at least one current-supply foil embedded within and extending along said at least one stem and connected at its inner and outer ends to an inner conductor and a terminal conductor respectively, the foil being fromed of a metal which is oxidizable when exposed to air at the elevated temperatures produced in use of the lamp, wherein the end face of said at least one stem is open to the atmosphere, said at least one stem has at least one rigid terminal conductor projecting from it, and a member having reflective surface facing said at least one lamp stem is attached to said rigid terminal conductor or conductors, the surface being non-perpendicular to the lamp axis so as to cause a substantial proportion of radiation which is incident upon it from the lamp to be directed away from the foil and adjacent region of the terminal conductor so as to reduce the temperature of at least the outer end of the foil when the lamp is in use, and thus reduce the tendency to oxidation, thereby lengthening the lamp life.

4. An air-exposed lamp according to claim 3 wherein the member having the reflective surface is a metal block.

5. An air-exposed lamp of the kind having an envelope in which there is contained means for generating light, the envelope being provided with at least one elongate stem which is at least partially transparent to radiations emanating from the interior of the envelope in use of the lamp, said at least one stem having an end face at a position remote from the envelope, at least one current-supply foil embedded within and extending along said at least one stem and connected at its inner and outer ends to an inner conductor and a terminal conductor respectively, the terminal conductor having a conducting lead connected thereto for carrying current to the terminal conductor from an electrical supply, and the foil being formed of a metal which is oxidizable when exposed to air at the elevated temperatures produced in use of the lamp, wherein said at least one stem is surrounded by a generally tubular lamp cap open at an outer end and fitting around said at least one stem for enabling the lamp to be supported thereby without enclosing the end face of said at least one stem, such thay said end face is open to the atmosphere, and wherein said end face is shaped and positioned to direct radiation incident upon it from the lamp away from the associated foil and terminal conductor so as to reduce the temperature of at least the outer end of the foil when the lamp is in use, and thus reduce the tendency to oxidation, thereby lengthening the lamp life.

6. An air-exposed lamp according to claim 5 wherein the conducting lead is unconnected to the lamp cap.

7. An air-exposed lamp according to claim 5 which is a double ended lamp having two lamp stems, wherein said generally tubular lamp cap is fitted around each lamp stem.

* * * * *

UNITED STATES PATENT AND TRADEMARK OFFICE

CERTIFICATE OF CORRECTION

PATENT NO. : 4,682,071

DATED : July 21, 1987

INVENTOR(S) : Angus Bernard Dixon, et. al.

It is certified that error appears in the above-identified patent and that said Letters Patent are hereby corrected as shown below:

On the Title Page, Item [19] should read -- Dixon et al --.

On the Title Page, Item [75] should read

-- [75] Inventors: Angus Bernard Dixon, Alan Prest and Paul Thorpe, all of England --

Signed and Sealed this

Nineteenth Day of April, 1988

*Attest:*

*Attesting Officer*

DONALD J. QUIGG

*Commissioner of Patents and Trademarks*